US010753115B2

(12) United States Patent
Perreault

(10) Patent No.: US 10,753,115 B2
(45) Date of Patent: Aug. 25, 2020

(54) UMBRELLA ANCHOR

(71) Applicant: Kevin J Perreault, Greenville, SC (US)

(72) Inventor: Kevin J Perreault, Greenville, SC (US)

( * ) Notice: Subject to any disclaimer, the term of this patent is extended or adjusted under 35 U.S.C. 154(b) by 171 days.

(21) Appl. No.: 15/817,159

(22) Filed: Nov. 17, 2017

(65) Prior Publication Data

US 2019/0153743 A1 May 23, 2019

(51) Int. Cl.

*E04H 12/22* (2006.01)
*A45B 23/00* (2006.01)
*A45B 25/00* (2006.01)

(52) U.S. Cl.

CPC ..... *E04H 12/2246* (2013.01); *A45B 23/00* (2013.01); *A45B 25/00* (2013.01); *A45B 2023/0006* (2013.01); *A45B 2023/0012* (2013.01); *A45B 2025/003* (2013.01)

(58) Field of Classification Search

CPC .... A45B 2023/0012; A45B 2023/0006; A45B 2025/003; E04H 12/2246; E04H 12/22; E04H 12/2238

See application file for complete search history.

(56) References Cited

U.S. PATENT DOCUMENTS 4,924,893 A * 5/1990 Furey ..... A45B 23/00 135/16
4,979,833 A * 12/1990 Cook ..... A45C 3/00 383/109
5,271,196 A 12/1993 Fanti
5,452,877 A 9/1995 Riffle et al.
6,164,613 A * 12/2000 Williams ..... E04H 12/2246 248/533
6,199,570 B1 3/2001 Patarra
6,446,649 B1 * 9/2002 Bigford ..... A45B 23/00 135/16
6,715,503 B2 4/2004 Brooks, III
7,007,703 B2 3/2006 Brooks, III
7,793,674 B2 9/2010 Elder
D625,508 S * 10/2010 Thurrott ..... D3/10
7,918,236 B2 4/2011 Elder
7,946,305 B1 * 5/2011 Mailman ..... A45B 25/22 135/120.1
8,047,217 B1 * 11/2011 Schermerhorn, Jr. ..... E04H 12/2246 135/118
8,191,561 B2 6/2012 Brooks, III
8,656,937 B1 * 2/2014 Minasi ..... A45B 25/22 135/118

(Continued)

*Primary Examiner* — David R Dunn
*Assistant Examiner* — Danielle Jackson

(57) ABSTRACT

The present invention is an anchor for a beach umbrella or the like. The umbrella anchor of the present invention includes generally an anchor bag configured to receive the end of a conventional beach umbrella shaft and an upper harness provided for securing the upper end of the umbrella shaft to the anchor bag. The anchor bag is filled with sand or other earthen material removed from a hole into which the anchor bag is placed while the umbrella anchor of the present invention is being deployed. An upper harness is mounted on the umbrella shaft and then releasable connected to an anchor bag harness fixed to the anchor bag. The umbrella anchor may further include a storage bag for receiving the anchor bag and proximal end of the beach umbrella when the umbrella is closed for storage, or for holding miscellaneous items when the umbrella is opened and anchored.

20 Claims, 10 Drawing Sheets

(56) References Cited

U.S. PATENT DOCUMENTS

| | | | | |
|---|---|---|---|---|
| 8,783,274 | B1 * | 7/2014 | Supino | A47G 25/12 135/118 |
| 9,644,391 | B1 * | 5/2017 | Urhausen | E04H 15/62 |
| 2002/0026890 | A1 * | 3/2002 | Zook | B63B 21/29 114/294 |
| 2004/0118058 | A1 * | 6/2004 | Bigford | A45B 23/00 52/169.13 |
| 2005/0011134 | A1 | 1/2005 | Boltan et al. | |
| 2012/0011773 | A1 * | 1/2012 | Cross | A01G 9/026 47/65.8 |
| 2013/0051707 | A1 * | 2/2013 | Pisano | A45B 23/00 383/75 |
| 2013/0092283 | A1 * | 4/2013 | Votel | E04H 12/2246 141/10 |
| 2014/0230866 | A1 | 8/2014 | Paolucci | |
| 2015/0013734 | A1 * | 1/2015 | Krystopher | E04H 12/2246 135/16 |
| 2015/0090307 | A1 | 4/2015 | Supino | |
| 2015/0320161 | A1 * | 11/2015 | Perry | A45B 25/00 248/533 |
| 2016/0192748 | A1 | 7/2016 | McQuaid et al. | |

* cited by examiner

UMBRELLA ANCHOR

CROSS-REFERENCE TO RELATED APPLICATIONS

None

FIELD OF THE DISCLOSURE

The present disclosure relates to umbrella anchors, and more particularly to a flexible anchor bag attached to the bottom of a beach umbrella and which is configured to be placed in a hole formed in the sand and then filled with the sand removed from the hole.

BACKGROUND OF THE DISCLOSURE

It is well known that annually, millions of people visit beaches around the world. While there are many activities on and around beaches, it is also well known that the effects of the sun can be harsh and sometimes dangerous. Therefore, many people take temporary shade with them, including among other things, beach umbrellas.

Beach umbrellas typically include a large canopy disposed on the distal end of a long shaft. While beach umbrellas are easy to operate and transport, a common problem is anchoring the beach umbrella such that it is stable. Due to the large size of the canopy, even with a small wind, the canopy catches the wind similarly to a parachute and causes the umbrella to fall or, in the worst case, be blown away. When an umbrella is blown away, it can be difficult to recapture, and while airborne creates a danger to those in its path.

Several solutions have been attempted to anchor an umbrella in the sand. These typically fall into three categories.

First, an anchor is configured to receive the proximal end of the umbrella shaft. The anchor may be some sort of plate, weighted bag, or frame. In either instance, the anchor is configured to be placed on the surface of the sand. These types of anchors do not effectively prevent the umbrella from tipping over.

A second type of anchor involves driving the proximal end of the umbrella shaft into the sand. To this extent, the umbrella shaft may define an auger at its proximal end in order to affectively screw the shaft into the sand. It has found that this, too, has been ineffective especially in higher winds.

Finally, a third type of anchor includes one or more straps connected at one end along the periphery of the umbrella canopy and at the other end into the sand via a stake. An alternative to this type is positioning the umbrella such that a portion of the periphery is engaged with the surface of the sand and one or more points along the periphery are anchored directly into the sand via a stake. In these embodiments, the umbrella either includes straps that create tripping hazards and limit ingress and egress from under the umbrella, or limit the amount of shade because the canopy is anchored directly into the sand.

Because neither of these anchors has proven effective in and of themselves, many solutions have included using two or more of the above types of anchors in various formats.

The present invention is provided as an improved solution to quickly and effectively anchor a beach umbrella into the sand while also allowing maximum flexibility with respect to orientation of the umbrella. When not in use, the anchor is configured to receive the proximal end of the umbrella in order to neatly store and easily transport the umbrella.

SUMMARY OF EXEMPLARY EMBODIMENTS OF THE DISCLOSURE

The present invention is an anchor for a beach umbrella or the like. The umbrella anchor of the present invention includes generally an anchor bag configured to receive the end of a conventional beach umbrella shaft and an upper harness provided for securing the upper end of the umbrella shaft to the anchor bag. The umbrella anchor may further include a storage bag for receiving the anchor bag and proximal end of the beach umbrella when the umbrella is closed for storage, or for holding miscellaneous items when the umbrella is opened and anchored.

The umbrella anchor is typically used for anchoring a beach umbrella in sand. The beach umbrella generally includes an umbrella shaft having a proximal end generally used for anchoring in a conventional weighted base or simply driven into the sand and a distal end at which is conventionally mounted a canopy.

The umbrella anchor generally includes an anchor bag, an anchor bag harness carried by the anchor bag, and an upper harness carried by the umbrella shaft and releasably connectable to the anchor bag harness. The anchor bag is configured to be received within a hole below grade, and for receiving the proximal end of the umbrella shaft and a sufficient amount of sand to weight the umbrella anchor and umbrella into the sand. The storage bag is releasably secured to the upper harness and is provided for storing personal belongings when in the set-up configuration and for receiving the proximal end of the umbrella shaft, the anchor bag and at least a portion of the anchor bag harness when the umbrella anchor is in the stored configuration.

The anchor bag is constructed of a durable fabric capable of withstanding the abrasiveness of sand. The perimeter of the anchor bag is folded over and sewn to define a circumferential hem in which a drawstring is received. A conventional cord lock is provided for receiving each of the first and second ends of the drawstring for preventing either end of the drawstring from being retracted into the hem when the drawstring is in the relaxed configuration and to maintain the drawstring in a drawn configuration when the drawstring is extended. A through opening is defined in the center of the anchor bag for receiving at least a portion of the proximal end of the umbrella shaft.

The anchor bag harness of the illustrated embodiment includes a plurality of straps extending radially away from the center of the anchor bag. Each strap defines a proximal end and a distal end. Each proximal end is secured in a conventional manner to a ring defining an opening, the ring being positioned proximate the anchor bag opening. The ring is further provided for reinforcing the anchor bag opening. Each of the straps is sewn or otherwise secured onto the anchor bag in order to maintain the relative dispositions of each strap with respect to each other and the anchor bag. The straps are disposed in an angular array. The distal end of each strap extends beyond the perimeter of the anchor bag and carries a first mating portion of a conventional buckle. In one embodiment, the female mating portion of a conventional buckle is configured to adjustably receive the distal end of a strap such that the buckle may be moved along the strap in order to adjust the effective length of the strap.

The upper harness generally includes a plurality of radially-spaced straps, each defining a proximal end secured to a mounting ring and a distal end secured to a second mating portion of the conventional buckle. The number of upper harness straps is the same as the number of anchor bag straps, and the radial displacement of the upper harness straps is the same as the angular displacement of the anchor bag straps. As a result, each anchor bag strap is releasably connectable to one of the upper harness straps via the conventional buckle.

The mounting ring is configured to be releasably secured to the umbrella shaft at a selected location. The proximal end of each upper harness strap is configured to define a loop for receiving the mounting ring. In the illustrated embodiment, the loop is configured by folding the proximal end of the strap over onto itself and then is secured in a conventional manner such as by sewing. The male mating portion of the conventional buckle is secured to the distal end of each strap.

In order to maintain the disposition of each of the upper harness straps relatively close to the umbrella shaft, and further in order to maintain the relative spacing of each of the upper harness straps, at least one retaining strap is provided to encircle the upper harness straps at a selected location along their length. In one embodiment, an upper retaining strap is positioned proximate the proximal ends of the upper harness straps and a lower retaining strap is positioned proximate the distal ends of the upper harness straps. Each of the upper and lower retaining straps is secured to the upper harness straps in a conventional manner such as by sewing. The length of each retaining strap is at least equal and preferably longer than the previous retaining strap starting with the uppermost retaining strap and moving toward the lowermost.

In order to mount the upper harness, the mounting ring is loosened to receive the umbrella shaft. The umbrella shaft is then inserted through the mounting ring, and each of the upper and lower retaining straps. Once the mounting ring is properly positioned along the length of the umbrella shaft, it is tightened in order to prevent it from unselected movement. The upper harness is configured such that it may remain mounted on the umbrella shaft and is easily received with the umbrella canopy when the canopy is closed, thereby reducing setup time after its initial installation.

The upper harness may also include an auxiliary strap for releasably securing other items such as the storage bag. The auxiliary strap defines a proximal end secured in a conventional manner at a selected location to the upper harness and a distal end to which is secured a first mating portion of a conventional buckle.

The storage bag is configured as an elongated bag of a selected length and diameter to receive the anchor bag and the proximal end of the umbrella shaft when the umbrella and anchor are not in use. The storage bag defines an open end defining a periphery around which is formed a peripheral hem for receiving a draw string. A conventional cord lock is provided for receiving each of the first and second ends of the drawstring for preventing either end of the drawstring from being retracted into the hem when the drawstring is in the relaxed configuration and to maintain the drawstring in a drawn configuration when the drawstring is extended.

The storage bag further includes an attachment strap having a proximal end secured to the cover and a distal end carrying a second mating portion of the conventional buckle. The attachment strap is fastened to an interior of the cover proximate the open end in a conventional manner such as by sewing. The distal end of the attachment straps extends from within the storage bag. When the cover is removed from the umbrella and the umbrella and anchor are in use, the cover is removably attachable to the auxiliary strap via the buckle and may then be used to store miscellaneous items such as keys, jewelry, sunscreen and the like.

When the conventional umbrella and the umbrella anchor of the present invention are not in use, the anchor bag may be emptied and then placed around the proximal end of the umbrella shaft. The upper harness may be left mounted in place on the umbrella shaft and the umbrella canopy closed. The anchor bag and proximal end of the umbrella shaft are then inserted into the storage bag through the open end. The length of the preferred embodiment of the storage bag is sufficient for at least a portion of the canopy to also be received therein. Once the proximal end of the umbrella shaft reaches the distal end of the cover, the drawstring is engaged to an extended position to close the open end, and the associated cord lock is slid along the drawstring toward the storage bag to maintain the drawstring in the extended position and prevent the storage bag from unselected removal.

In order to install a conventional umbrella using the umbrella anchor of the present invention. A user first digs a hole at a selected location, the hole being of sufficient size to receive the anchor bag when filled. Sand from the hole is gathered for filling the anchor bag. The anchor bag is then laid into the hole with the anchor bag harness positioned under the anchor bag. The anchor bag is then filled with the sand removed from the hole and the drawstring is engaged to an extended position to at least partially close the anchor bag in order to retain the sand placed therein. The associated cord lock is then slid along the drawstring toward the anchor bag to maintain the drawstring in the extended position and prevent the sand from the anchor bag from unselected removal. The excess sand is then replaced in the remaining portion of the hole around the anchor bag and then is used to cover the anchor bag. Each anchor bag strap is then secured to one each of the upper harness straps via the conventional buckles. The umbrella canopy is then extended for use. If desired, the cover is attached to the auxiliary strap via the connection strap and associated conventional buckle.

To disassemble or take down the conventional umbrella and anchor of the present invention, the above described steps are essentially performed in reverse order. After disassembly, the conventional umbrella and anchor of the present invention may be secured together as stored as described above.

BRIEF DESCRIPTION OF THE DRAWINGS

The foregoing and other objects of the present disclosure will be apparent upon consideration of the following detailed description, taken in conjunction with the accompanying drawings and claims, in which like reference characters refer to like parts throughout, and in which:

DETAILED DESCRIPTION OF EXEMPLARY EMBODIMENTS OF DISCLOSURE

Figure 1:
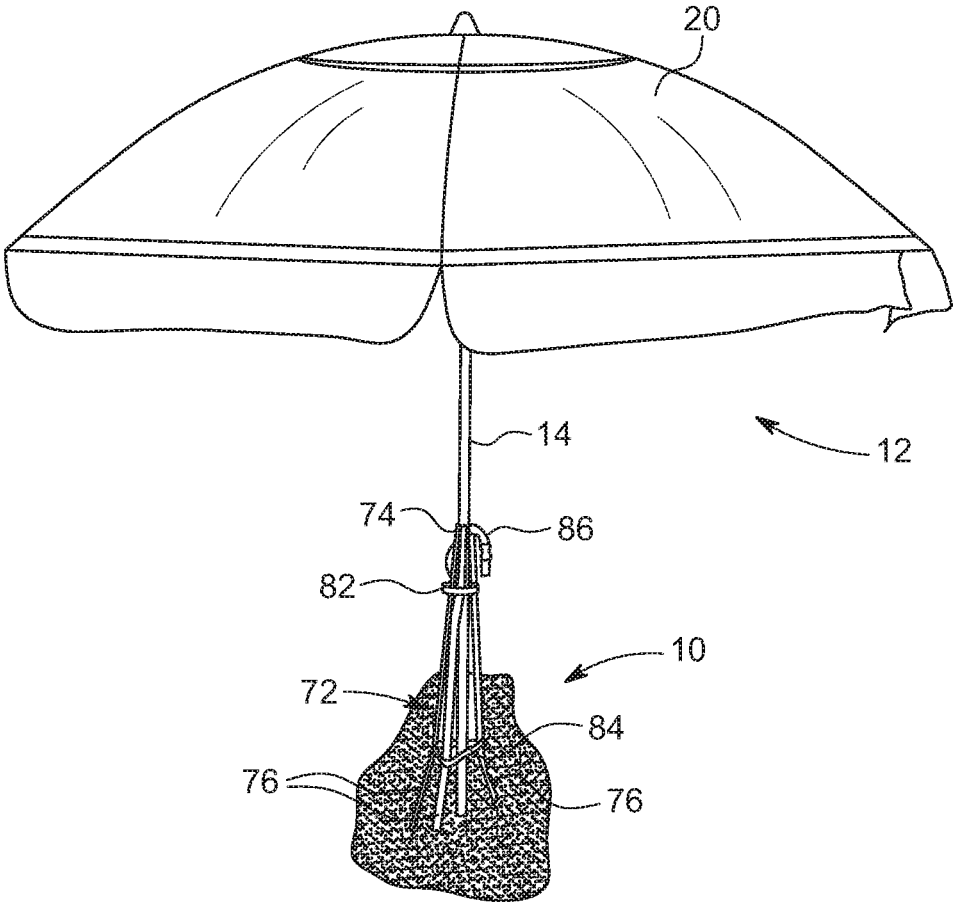
FIG. 1 is a perspective view of the umbrella anchor shown anchoring a conventional beach umbrella.

The present invention is an umbrella anchor 10 for a beach umbrella 12 or the like. The umbrella anchor 10 of the present invention includes generally an anchor bag 24 configured to receive the proximal end 16 of a conventional beach umbrella shaft 14 and an upper harness 72 provided for securing the distal end 18 of the umbrella shaft 14 to the anchor bag 24. In an alternate embodiment, the umbrella anchor 10 further includes a storage bag 104 for receiving the anchor bag 24 and proximal end 16 of the beach umbrella shaft 14 when the umbrella 12 is closed for storage, or for holding miscellaneous items when the umbrella 12 is opened and anchored.

Referring to FIG. 1, the umbrella anchor 10 is illustrated in use for anchoring a beach umbrella 12 in sand. The beach umbrella 12 generally includes an umbrella shaft 14 having a proximal end 16 generally used for anchoring in a conventional weighted base (not illustrated) or simply driven into the sand or other earthen material and a distal end 18 at which is conventionally mounted a canopy 20. The canopy 20 is opened and closed in a conventional manner.

Figure 2:
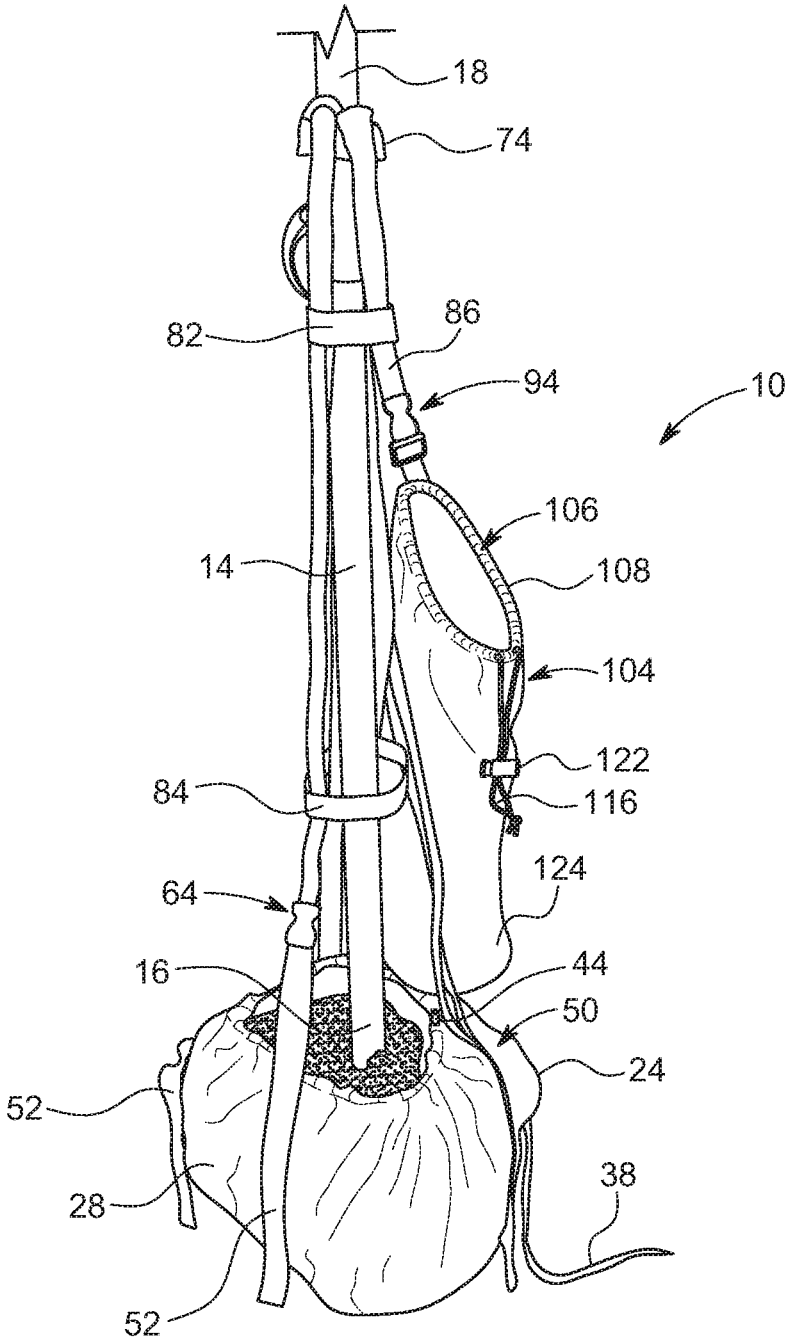
FIG. 2 is a perspective view of the umbrella anchor of the present invention shown as installed on a conventional beach umbrella.

FIG. 2 illustrates more clearly the umbrella anchor 10 of the present invention shown as it would be set up but removed from the ground. The umbrella anchor 10 generally includes an anchor bag 24, an anchor bag harness 50 carried by the anchor bag 24, and an upper harness 72 carried by the umbrella shaft 14 and releasably connectable to the anchor bag harness 50. As will be described in more detail below, the anchor bag 24 is configured to be received within a hole 126 below grade, and for receiving the proximal end 16 of the umbrella shaft 14 and a sufficient amount of sand 128 to weight the umbrella anchor 10 and umbrella 12 into the sand 128. Further included in the illustrated embodiment is a storage bag 104 that is releasably secured to the upper harness 72 and is provided for storing personal belongings when in the set-up configuration as illustrated in FIG. 2, and for receiving the proximal end 16 of the umbrella shaft 14, the anchor bag 24 and at least a portion of the anchor bag harness 50 when the umbrella anchor 10 of the present invention is in the stored configuration, as will be described in greater detail below.

Figure 3:
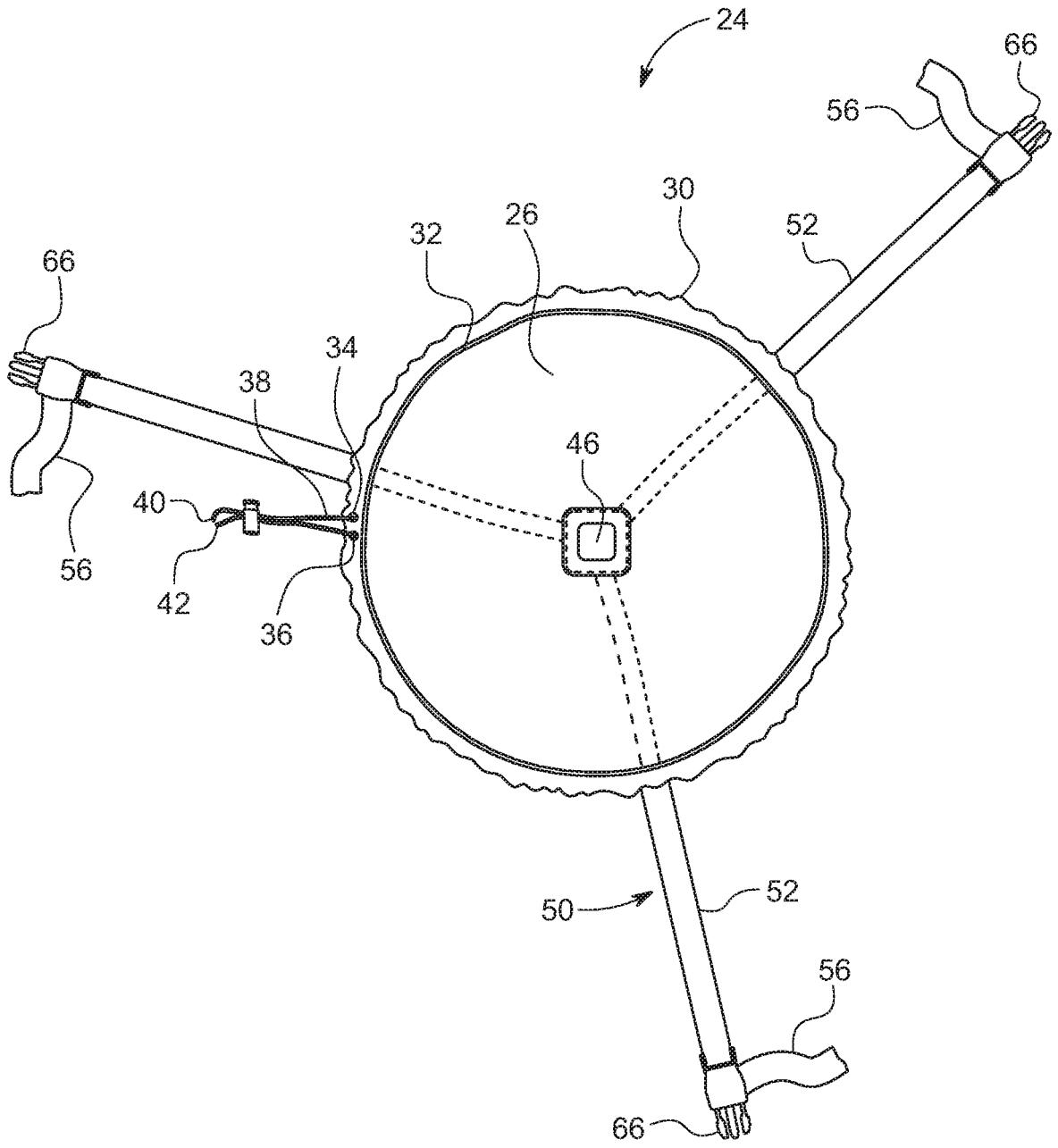
FIG. 3 is a top plan view of an anchor bag of the umbrella anchor of the present invention.
Figure 4:
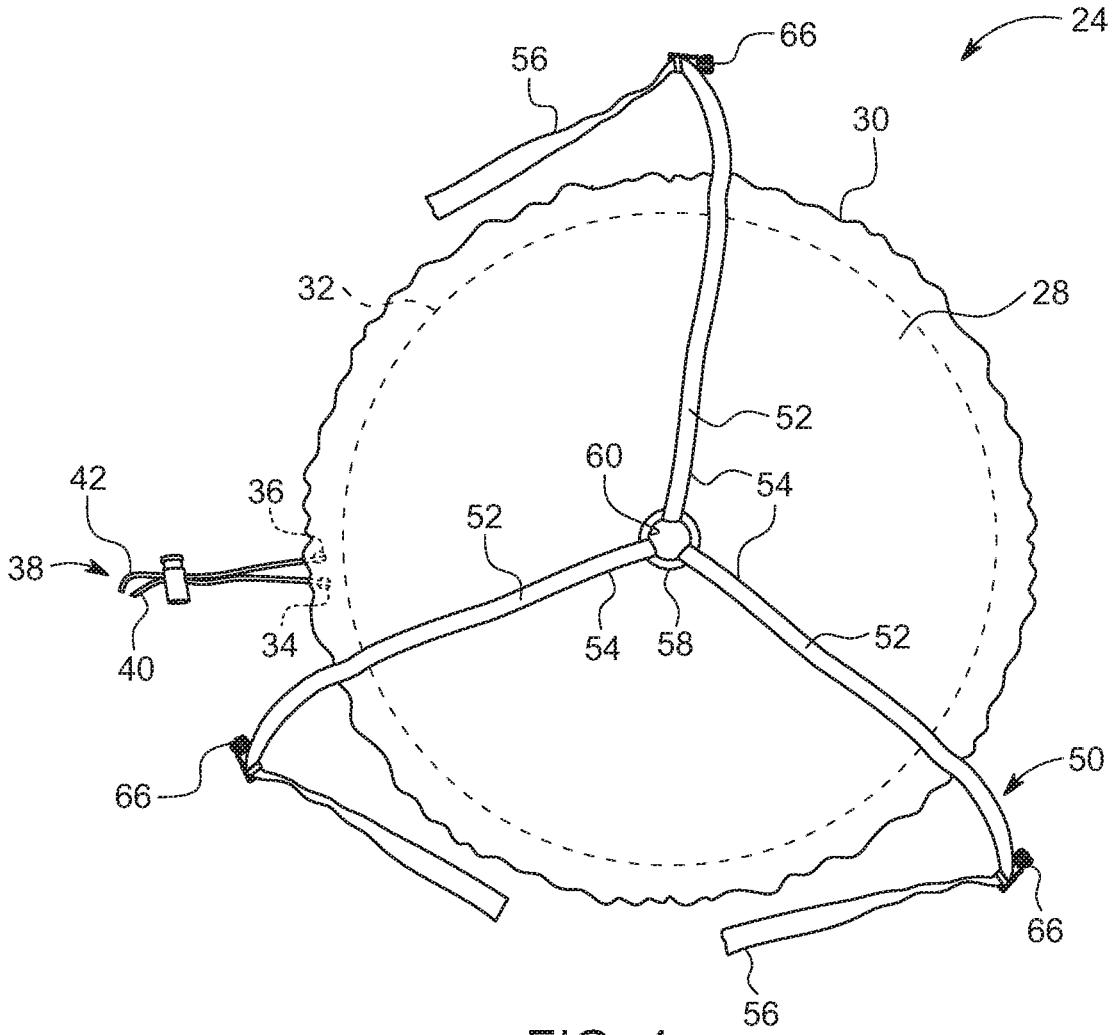
FIG. 4 is a bottom plan view of the anchor bag of FIG. 3.

FIG. 3 and FIG. 4 illustrate one embodiment of the anchor bag 24 of the present invention. FIG. 3 illustrates the upper or inside surface 26 of the anchor bag 24 and FIG. 4 illustrates the lower or outside surface 28 of the anchor bag 24. The anchor bag 24 includes an anchor bag substrate constructed of a durable fabric capable of withstanding the abrasiveness of sand. The perimeter 30 of the anchor bag 24 is folded over and sewn to define a circumferential hem 32 in which a drawstring 38 is received. First and second openings 34,36 are defined at the ends of the hem 32, through which first and second ends 40,42 of the drawstring 38 are extended. In the illustrations of FIG. 3 and FIG. 4, the drawstring 38 is shown in a retracted configuration, and specifically with the drawstring 38 being retracted into the circumferential hem 32, thereby allowing the anchor bag 24 to substantially lay flat. A conventional cord lock 44 is provided for receiving each of the first and second ends 40,42 of the drawstring 38 for preventing either end 40,42 of the drawstring 38 from being retracted into the hem 32 when the drawstring 38 is in the illustrated relaxed configuration and to maintain the drawstring 38 in an extended configuration when the drawstring 38 is drawn (as illustrated more clearly in FIG. 2). A through opening 46 is defined in the center of the anchor bag 24 for receiving at least a portion of the proximal end 16 of the umbrella shaft 14.

As more clearly illustrated in FIG. 4, the anchor bag harness 50 of the illustrated embodiment includes a plurality of straps 52 extending radially away from the center of the anchor bag 24. In the illustrated embodiment, three straps 52 are provided. Each strap 52 defines a proximal end 54 and a distal end 56. Each proximal end 54 is secured in a conventional manner to a ring 58 defining an inner diameter or opening 60, the ring 58 being positioned proximate the anchor bag opening 46. The ring 58 is further provided for reinforcing the anchor bag opening 46. It will be understood by those skilled in the art that the ring 58 may be omitted and the proximal ends 54 of each strap 52 secured directly to the anchor bag 24. In the illustrated embodiment, the proximal end 54 of each strap 52 is received through the opening 60 in the ring 58, folded over onto itself and secured in place in a conventional manner such as by sewing. Each of the straps 52 is then sewn or otherwise secured onto outer side 28 of the anchor bag 24 in order to maintain the relative dispositions of each strap 52 with respect to each other strap 52 and the anchor bag 24. The straps 52 are disposed in an angular array. In the illustration with three straps 52, the straps 52 are disposed at an approximate 120° angular spacing. It will be understood that with more or fewer straps 52, the angular spacing is smaller or larger, respectively, as determined by dividing 360° by the number of straps 52 provided. The distal end 56 of each strap 52 extends beyond the perimeter 30 of the anchor bag 24 and is received within a first mating portion 66 of a conventional buckle 64. In the illustrated embodiment, the first mating portion 66 is the male portion 66 of a conventional buckle 64 and is configured to adjustably receive the distal end 56 of a strap 52 such that the buckle 64 may be moved along the strap 52 in order to adjust the effective length of the strap 52, as will be discussed in greater detail below.

Figure 5:
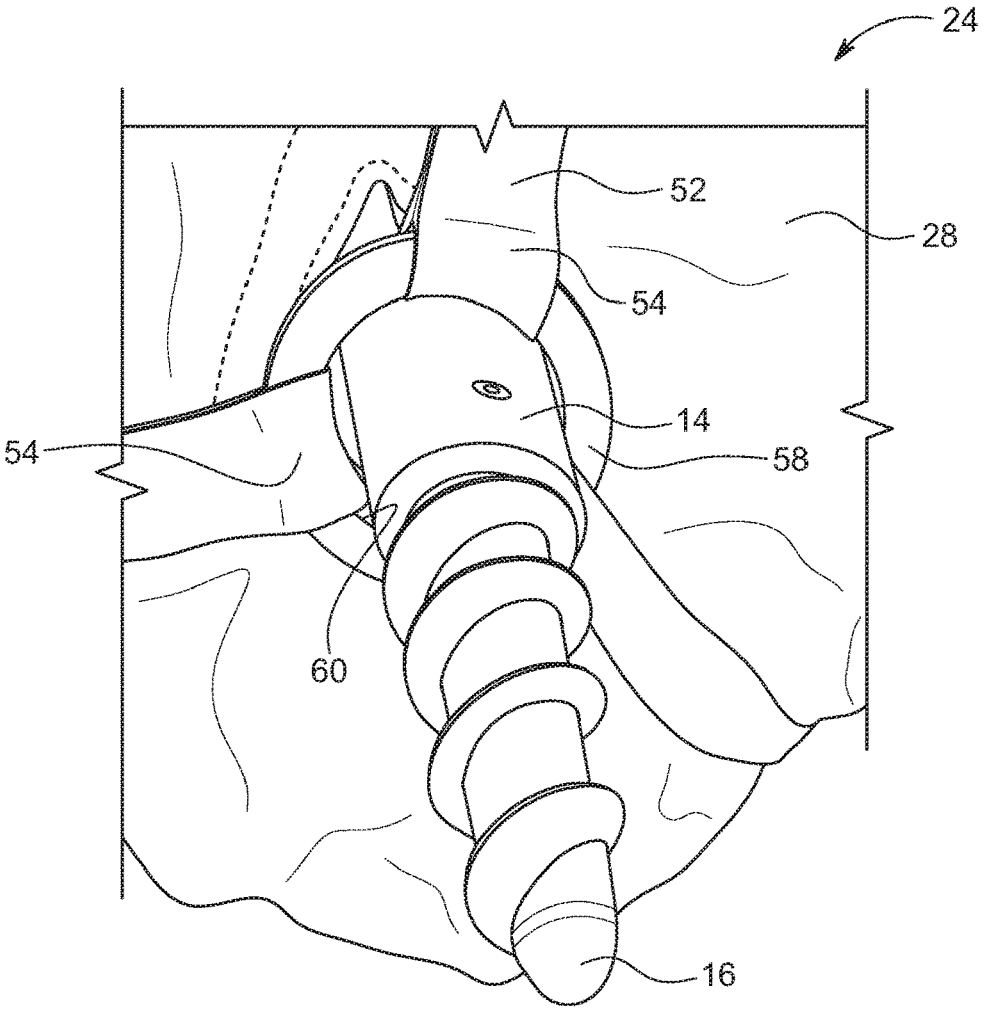
FIG. 5 is a bottom perspective view of a portion of the anchor bag of the present invention showing the proximal end of a convention beach umbrella shaft extending through a center opening.

FIG. 5 more clearly illustrates the proximal end 16 of a conventional umbrella shaft 14 being closely received through the through opening 46 defined in the center of the anchor bag 24, as well as the ring 58. The diameter of the anchor bag through opening 46 and the inner diameter 60 of the ring 58 are larger than the diameter of at least a portion of the umbrella shaft 14. However, it is not necessary that there be a close tolerance between the anchor bag through opening 46 and the ring inner diameter 60, or with either of these and the umbrella shaft 14 diameter.

Figure 6:
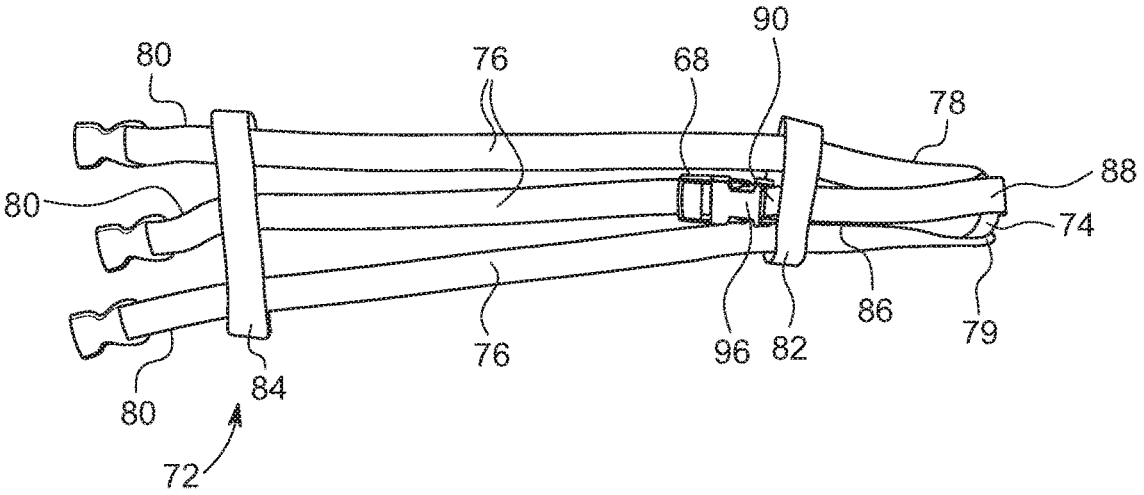
FIG. 6 is a side elevation view of an upper harness of the umbrella anchor of the present invention.

Illustrated in FIG. 6 is the upper harness 72, which generally includes a plurality of radially-spaced straps 76, each defining a proximal end 78 secured to a mounting ring 74 and a distal end 80 secured to a second mating portion 68 of the conventional buckle 64. The number of upper harness straps 76 is preferably the same as the number of anchor bag harness straps 52, and the radial displacement of the upper harness straps 76 is the same as the angular displacement of the anchor bag harness straps 52. As a result, each anchor bag harness strap 52 is releasably connectable to one of the upper harness straps 76 via one of the conventional buckles 64.

The mounting ring 74 is configured to be releasably secured to the umbrella shaft 14 at a selected location. In the illustrated embodiment, the mounting ring 74 is a metallic band 74 having an adjustment member 75 for adjusting the diameter of the ring 74 to facilitate mounting and removal of the upper harness 72 to and from the umbrella shaft 14. However, it will be understood that many conventional fasteners having adjustable diameters for this purpose are available and may be substituted.

The proximal end 78 of each upper harness strap 76 is configured to define a loop 79 for receiving the mounting ring 74. In the illustrated embodiment, the loop 79 is configured by folding the proximal end 78 of the strap 76 over onto itself and then is secured in a conventional manner such as by sewing. For a mounting ring 74 fabricated from a textile such as another strap (not shown), it will be understood that the proximal end 78 of each strap 76 could be conventionally secured directly to the mounting ring 74.

The second mating portion 68 of the conventional buckle 64 is carried by the distal end 80 of each strap 76. In the illustrated embodiment, the second mating portion 68 is the female portion of the conventional buckle 64. Because the male portion 66 of the buckle 64 is adjustable along the length of each anchor bag harness strap 52 in the illustrated embodiment, it is not necessary that the female portion 68 of the buckle 64 be adjustable along the length of the upper harness strap 76. However, it will be understood that the mating portions 66,68 of the conventional buckle 64 can be reversed such the length of each upper harness strap 76 is adjustable. When the first and second mating portions 66,68 of the buckle 64 are coupled, a plurality of anchor bag harness strap 52/upper harness strap 76 pairs are formed.

In order to maintain the disposition of each of the upper harness straps 76 relatively close to the umbrella shaft 14, and further in order to maintain the relative spacing of each of the upper harness straps 76, at least one retaining strap 82 is provided to encircle the upper harness straps 76 at a selected location along their length. In the illustrated embodiment, an upper retaining strap 82 is positioned proximate the proximal ends 78 of the upper harness straps 76 and a lower retaining strap 84 is positioned proximate the distal ends 80 of the upper harness straps 76. Each of the upper and lower retaining straps 82,84 is secured to the upper harness straps 76 in a conventional manner such as by sewing. The length of each retaining strap 82 is at least equal and preferably longer than the previous retaining strap 82 starting with the uppermost retaining strap and moving toward the lowermost. For the illustrated upper and lower retaining straps 82,84, the lower retaining strap 84 is longer than the upper retaining strap 82.

Figure 7:
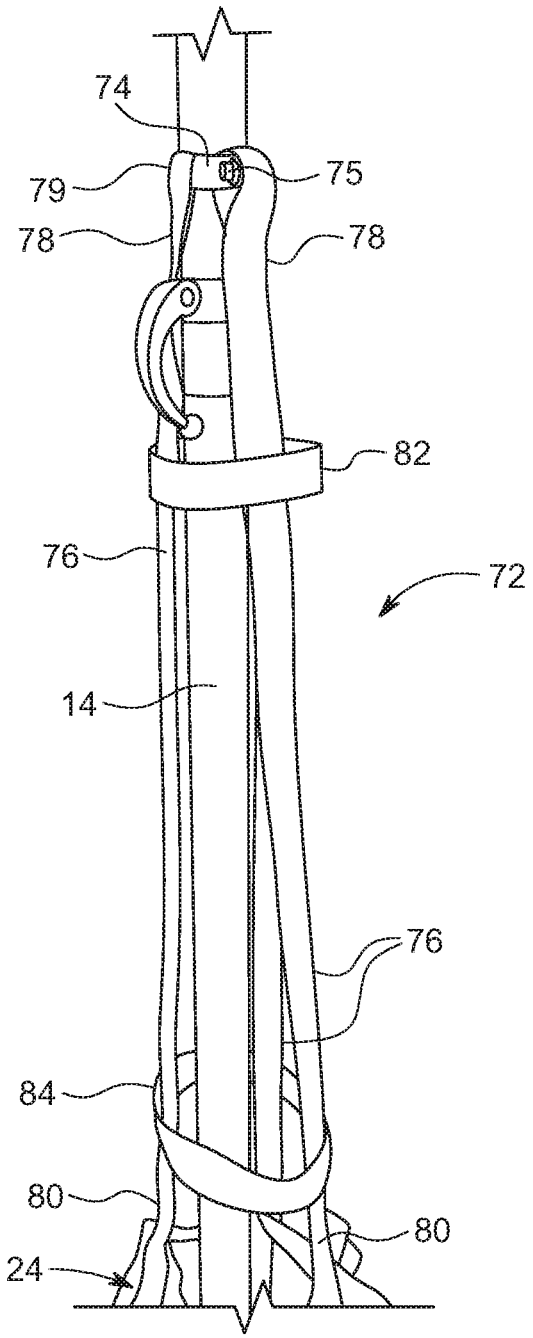
FIG. 7 is a side elevation view of the upper harness of FIG. 6 illustrated as installed on a convention beach umbrella shaft.

FIG. 7 illustrates the upper harness 72 as mounted on a conventional umbrella shaft 14. In order to mount the upper harness 72, the mounting ring 74 is loosened to receive the umbrella shaft 14. The umbrella shaft 14 is then inserted through the mounting ring 74, and each of the upper and lower retaining straps 82,84. Once the mounting ring 74 is properly positioned along the length of the umbrella shaft 14, it is tightened in order to prevent it from unselected movement. The upper harness 72 is configured such that it may remain mounted on the umbrella shaft 14 and is easily received with the umbrella canopy 20 when the canopy 20 is closed, thereby reducing setup time after its initial installation.

Figure 8:
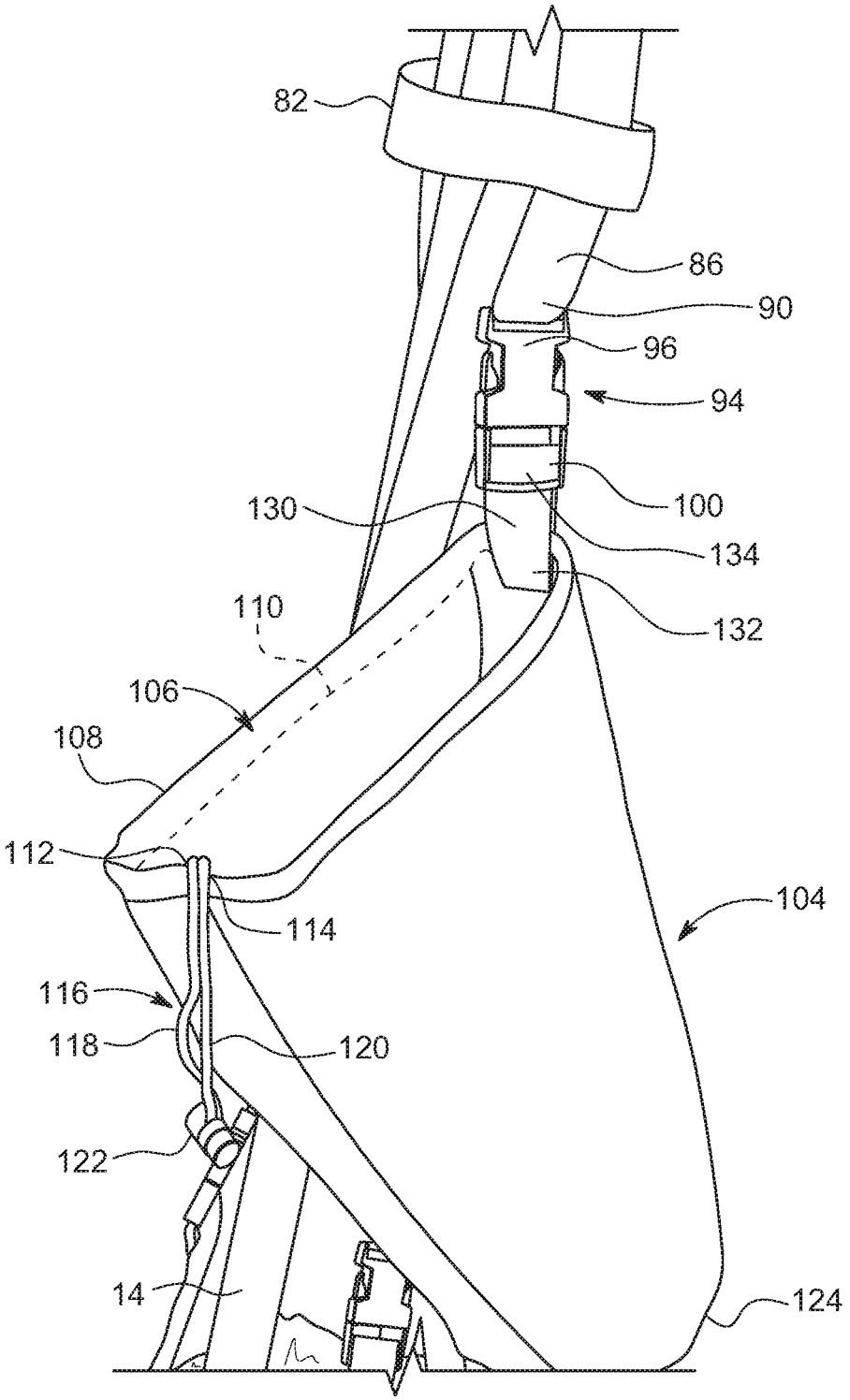
FIG. 8 is a perspective view of a storage bag of the present invention illustrated as being removably attached to the upper harness when the umbrella anchor of the present invention is deployed to anchor a convention beach umbrella.

The upper harness 72 may also include an auxiliary strap 86 as illustrated in FIG. 6 and more clearly illustrated in FIG. 8. The auxiliary strap 86 is provided for releasably securing other items such as the storage bag 104. The auxiliary strap 86 defines a proximal end 88 secured in a conventional manner at a selected location to the upper harness 72 and a distal end 90 to which is secured a first mating portion 96 of a conventional buckle 94. In the illustrated embodiment, the proximal end 88 of the auxiliary strap 86 is secured between the upper retaining strap 82 and one of the upper harness straps 76. This location was selected as a matter of convenience in manufacturing as it does not require an additional assembly step with respect to the attachment of the auxiliary strap 86. However, it will be understood that other acceptable locations may be used as well.

The storage bag 104 illustrated in FIG. 8 is configured as an elongated bag of a selected length and diameter to receive the anchor bag 24 and the proximal end 16 of the umbrella shaft 14 when the conventional umbrella 12 and umbrella anchor 10 of the present invention are not in use. The elongated bag 104 defines an open end 106 defining a periphery 108 around which is formed a peripheral hem 110 for receiving a drawstring 116. First and second openings 112,114 are defined at the ends of the hem 110, through which first and second ends 118,120 of the drawstring 116 are extended. In the illustration of FIG. 8, the drawstring 116 is shown in a retracted configuration, and specifically with the drawstring 116 being retracted into the circumferential hem 110, thereby allowing the open end 106 of the storage bag 104 to be fully opened. A conventional cord lock 122 is provided for receiving each of the first and second ends 118,120 of the drawstring 116 for preventing either end 118,120 of the drawstring 116 from being retracted into the hem 110 when the drawstring 116 is in the illustrated relaxed configuration and to maintain the drawstring 116 in an extended configuration when the drawstring 116 is drawn as illustrated in FIG. 9.

The storage bag 104 of the illustrated embodiment further includes an attachment strap 130 having a proximal end 132 secured to the storage bag 104 and a distal end 134 carrying a second mating portion 100 of the conventional buckle 94. In the illustrated embodiment, the attachment strap 130 is fastened to an interior of the storage bag 104 proximate the open end 106 in a conventional manner such as by sewing. The distal end 134 of the attachment strap 130 extends from within the storage bag 104. In the illustrated embodiment, the first mating member 96 is the female portion of the conventional buckle 94 and is carried by the auxiliary strap 86 and the second mating member 100 is the male portion of the buckle 94 and is carried by the storage bag attachment strap 130. Thus, when the storage bag 104 is removed from the umbrella 12 and the umbrella 12 and umbrella anchor 10 are in use, the storage bag 104 is removably attachable to the auxiliary strap 86 via the buckle 94 and may then be used to store miscellaneous items such as keys, jewelry, sunscreen and the like (not shown).

Figure 9:
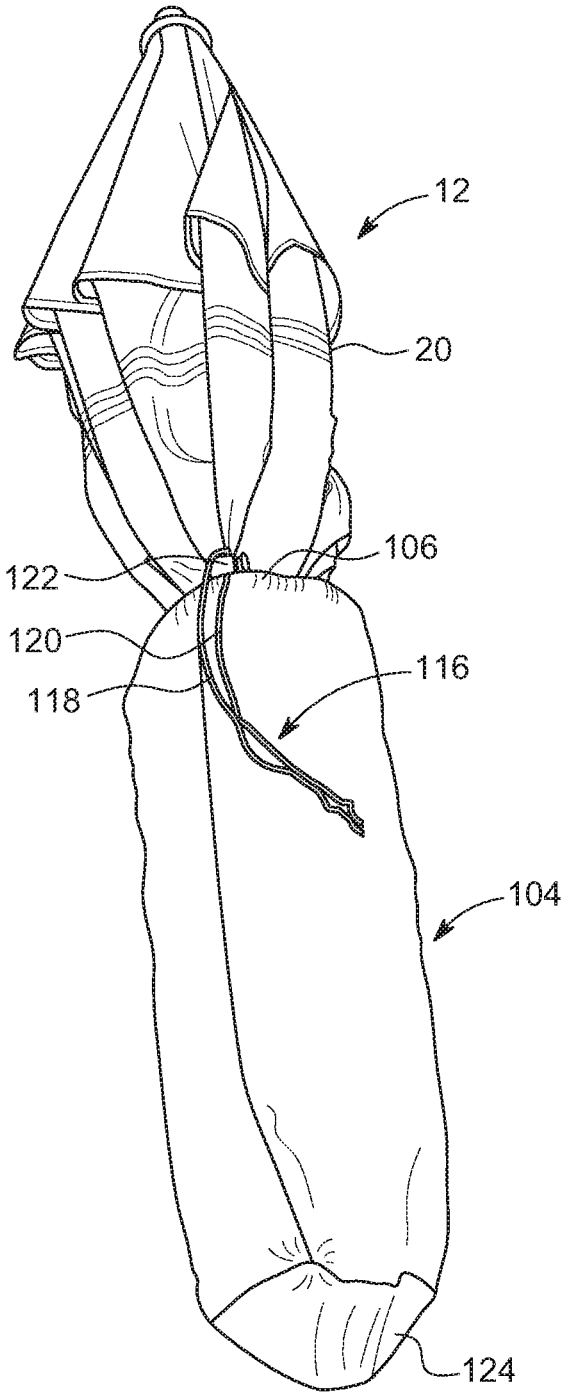
FIG. 9 is a perspective view of the storage bag illustrated in FIG. 8, shown receiving the anchor bag, the proximal end of the convention beach umbrella shaft and a portion of the beach umbrella canopy in order to store the umbrella anchor of the present invention and the conventional beach umbrella with not in use.

Referring now to FIG. 9, as described above, when the conventional umbrella 12 and the umbrella anchor 10 of the present invention are not in use, the anchor bag 24 may be emptied and then placed around the proximal end 16 of the umbrella shaft 14. The upper harness 72 may be left mounted in place on the umbrella shaft 14 and the umbrella canopy 20 closed. The anchor bag 24 and proximal end 16 of the umbrella shaft 14 are then inserted into the storage bag 104 through the open end 106. The length of the preferred embodiment of the storage bag 104 is sufficient for at least a portion of the canopy 20 to also be received with the storage bag 104, thereby retaining any loose sand remaining on the anchor bag 24. Once the proximal end 16 of the umbrella shaft 14 reaches the distal end 124 of the storage bag 104, the drawstring 116 is engaged to an extended position to close the open end 106 of the storage bag 104, and the associated cord lock 122 is slid along the drawstring 116 toward the storage bag 104 to maintain the drawstring 116 in the extended position and prevent the storage bag 104 from unselected removal.

Figure 10:
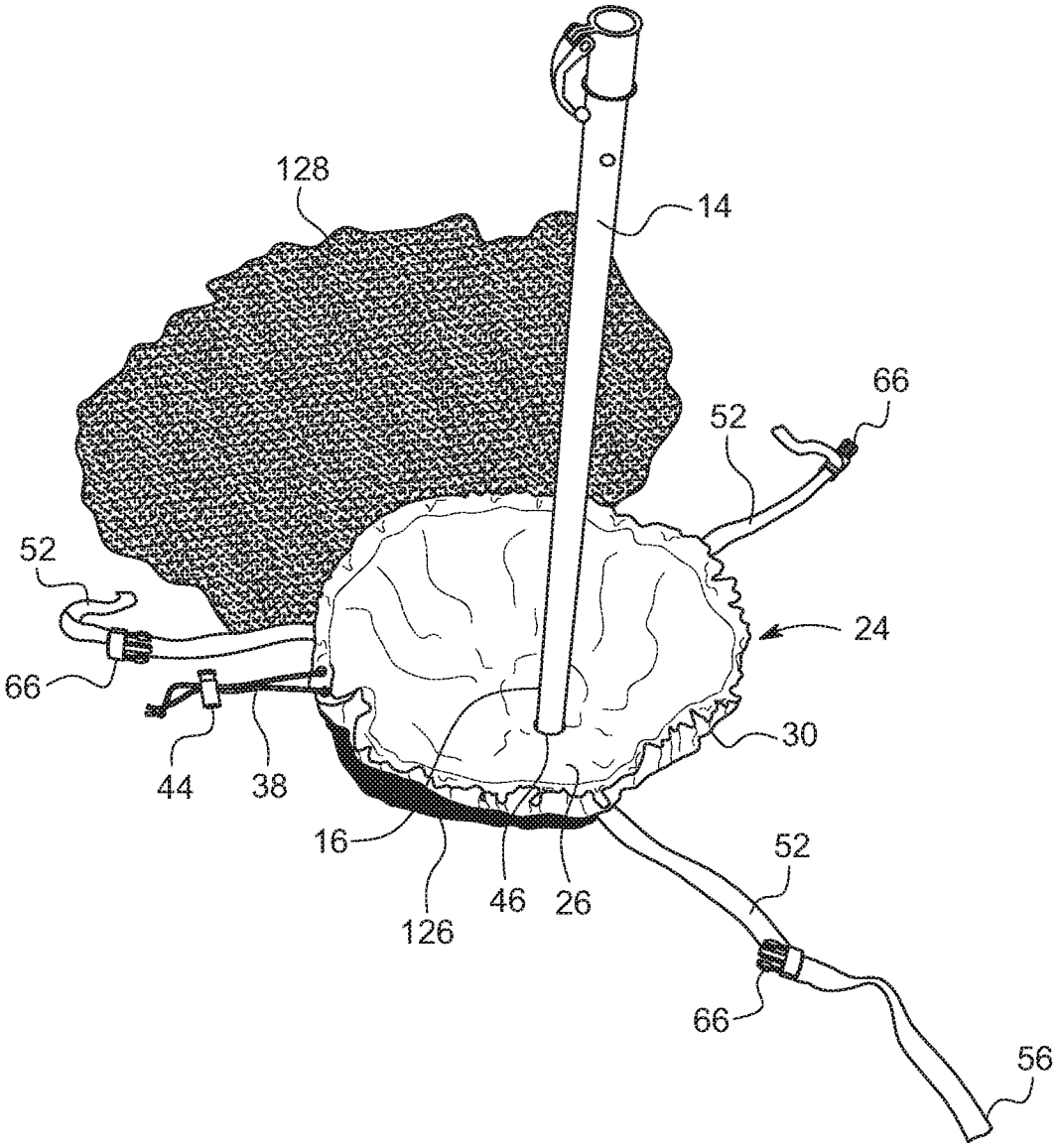
FIG. 10 illustrates the method of installing the umbrella anchor of the present invention showing a hole having been formed, the anchor bag placed within the hole, and the convention beach umbrella shaft being secured through the anchor bag through opening and into the sand below.
Figure 11:
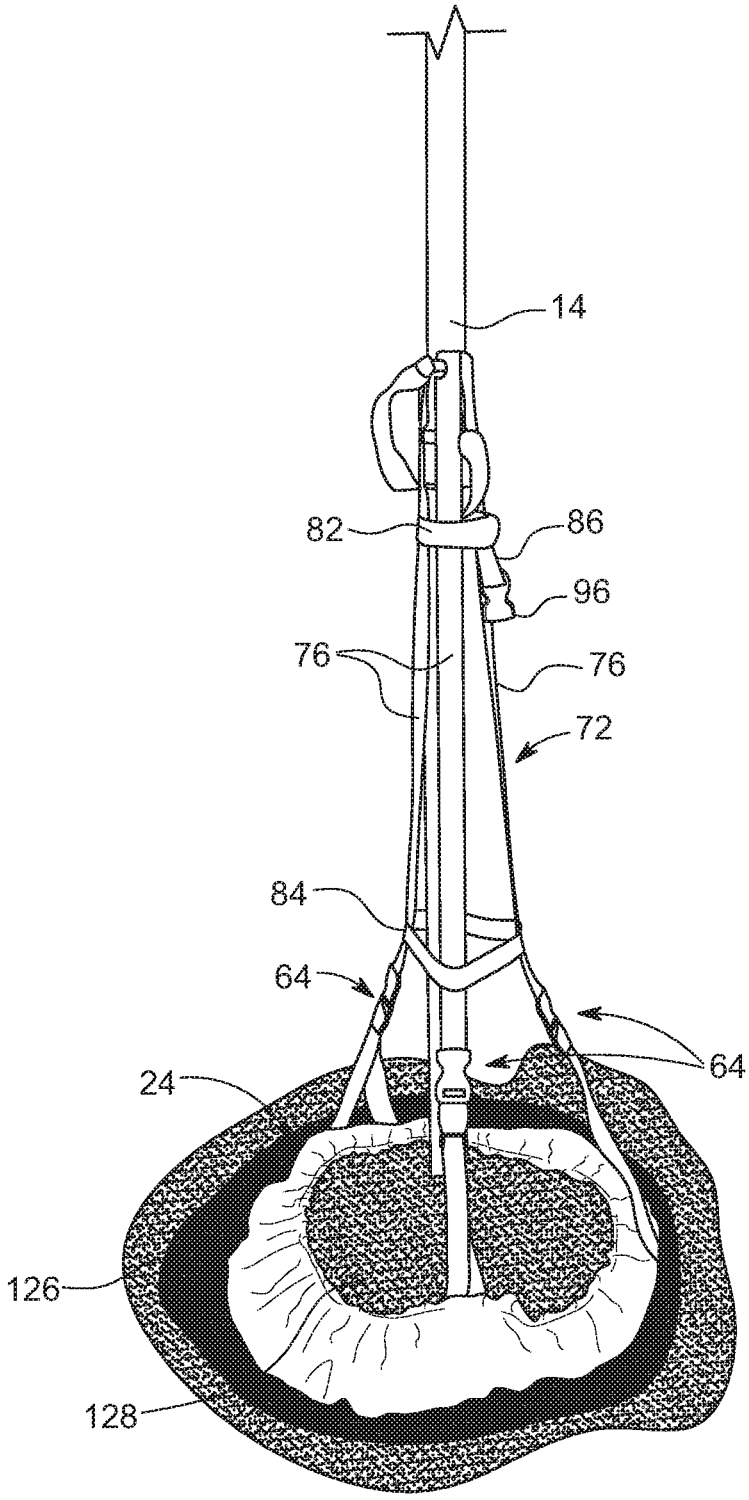
FIG. 11 illustrates the method of installing the umbrella anchor of the present invention showing the anchor bag having been filled with sand and then closed, and the upper harness having been secured to the conventional beach umbrella shaft and then to the anchor bag harness.

FIG. 10 and FIG. 11 more clearly illustrate the installation or set up of a conventional umbrella 12 using the umbrella anchor 10 of the present invention. A user first digs a hole 126 at a selected location, the hole 126 being of sufficient size to receive the anchor bag 24 when filled, as illustrated in FIG. 2. Dirt or sand 128 from the hole 126 is gathered for filling the anchor bag 24. For purposes of this disclosure, reference will be made to sand, but it will be understood that the anchor of the present invention could be placed in various types of earthen material. The diameter of the hole 126 is approximately equal to or slightly smaller than the diameter of the anchor bag 24, taking into account that the diameter of the filled anchor bag 24 will be smaller than the anchor bag 24 when laid flat. The anchor bag 24 is then laid into the hole 126 with the anchor bag harness 50 being positioned under the anchor bag 24. The anchor bag 24 is then filled with the sand 128 removed from the hole 126 and the drawstring 38 is engaged to an extended position to at least partially close the anchor bag 24 in order to retain the sand placed therein. The associated cord lock 44 is then slid along the drawstring 38 toward the anchor bag 24 to maintain the drawstring 38 in the extended position and prevent the sand 128 in the anchor bag 24 from unselected removal therefrom. The excess sand 128 is then replaced in the remaining portion of the hole 126 around the anchor bag 24 and then is used to cover the anchor bag 24, as more clearly illustrated in FIG. 1. Each anchor bag harness strap 52 is then secured to one each of the upper harness straps 76 via the conventional buckles 64. The umbrella canopy 20 is then deployed for use. If desired, the storage bag 104 is attached to the auxiliary strap 86 via the connection strap 130 and associated conventional buckle 94.

To disassemble or take down the conventional umbrella 12 and umbrella anchor 10 of the present invention, the above described steps are essentially performed in reverse order. After disassembly, the conventional umbrella 12 and umbrella anchor 10 of the present invention may be secured together and stored as described above in relation to FIG. 9.

The foregoing merely illustrates the principles of the disclosure. Various modifications and alterations to the described embodiments will be apparent to those skilled in the art in view of the teachings herein. It will thus be appreciated that those skilled in the art will be able to devise numerous apparatuses, arrangements, manufacture and methods which, although not explicitly shown or described herein, embody the principles of the disclosure and are thus within the spirit and scope of the disclosure. The disclosures of all documents and publications cited herein are hereby incorporated herein by reference in their entireties.

What is claimed is:

1. An umbrella anchor for anchoring a conventional umbrella into a selected earthen material, the conventional umbrella including an umbrella shaft having a proximal end and a distal end and a canopy disposed at the distal end of the umbrella shaft, said umbrella anchor comprising:

an anchor bag configured to be received within a hole defined below grade by removing a selected volume of earthen material from the ground and for receiving at least a portion of said selected volume of earthen material, said anchor bag including:

an anchor bag substrate fabricated from a durable material having an upper surface and a lower surface when laid flat, said bag substrate defining a perimeter about which is formed a circumferential hem extending substantially about said perimeter, said circumferential hem defining a first opening at a first end thereof and a second opening at a second end thereof, and said anchor bag substrate defining a through opening at an approximate center thereof for receiving at least a portion of the conventional umbrella shaft proximal end;

a drawstring received within said circumferential hem, said drawstring defining a first end extending from said first opening in said circumferential hem and a second end extending from said second opening in said circumferential hem, said drawstring provided for reducing said perimeter of said anchor bag substrate when said portion of said selected volume of earthen material is placed on said anchor bag substrate; and a conventional cord lock configured to slidably receive said drawstring first and second ends, said cord lock being slidable along said drawstring when engaged and to maintain a relative position with said drawstring when not engaged;

an anchor bag harness disposed on and carried by said anchor bag substrate lower surface, said anchor bag harness including:

a plurality of anchor bag harness straps, each defining a proximal end disposed proximate said anchor bag substrate through opening and a distal end extending beyond said anchor bag substrate perimeter, said plurality of anchor bag harness straps being oriented radially away from said anchor bag substrate through opening and being substantially equally spaced apart in an angular array, a portion of each of said plurality of anchor bag harness straps from about said proximal end to about said anchor bag substrate perimeter being selectively secured to said anchor bag substrate; and a plurality of first mating portions of a conventional buckle, one each of said plurality of first mating portions for engaging said distal end of one each of said plurality of anchor bag harness straps; and an upper harness removably attached to the umbrella shaft, and releasably attached to said anchor bag harness, said upper harness including:

a mounting ring configured to be releasably attachable to said conventional umbrella shaft at a selected location;

a plurality of upper harness straps, each defining a proximal end secured to said mounting ring and a distal end, said plurality of upper harness straps being substantially equally spaced apart in an angular array relative to each other of said plurality of upper harness straps, wherein said plurality of upper harness straps is equal to said plurality of anchor bag harness straps;

a plurality of second mating portions of said conventional buckle, one each of said plurality of second mating portions for engaging said distal end of one each of said plurality of upper harness straps, and one each of said plurality of second mating portions of said conventional buckle being releasably engageable with one of said plurality of first mating portions of said conventional buckle to form a plurality of anchor bag harness strap/upper harness strap pairs, wherein one of said plurality of first mating portions and said plurality of second mating portions is slidably received on a respective of said plurality of anchor bag harness straps and said plurality of upper harness straps in order to adjust tension on each of said plurality of anchor bag harness strap/upper harness strap pairs; and at least one retaining strap configured to encircle and be secured to each of said plurality of upper harness straps at a selected location, in order to maintain said angular array.

2. The umbrella anchor of claim 1 wherein said earthen material is sand and wherein said conventional umbrella is a beach umbrella.

3. The umbrella anchor of claim 1 wherein said anchor bag harness further includes a ring member defining an opening having an inner diameter, said ring being disposed proximate said anchor bag substrate through opening, wherein said proximal end of each of said plurality of anchor bag harness straps is received through said ring opening and secured to itself in a conventional manner.

4. The umbrella anchor of claim 3 wherein each of said anchor bag substrate through opening and said ring member opening are larger than a diameter of at least a portion of said umbrella shaft.

5. The umbrella anchor of claim 1 wherein each of said plurality of first mating portions is a male portion and is configured to be slidably engaged with one each of said plurality of anchor bag harness strap distal ends, and wherein each of said plurality of second mating portions is a female portion and is fixedly secured to one each of said plurality of upper harness strap distal ends.

6. The umbrella anchor of claim 1 further comprising a storage bag, said storage bag configured to receive at least said anchor bag and said umbrella shaft proximal end when said anchor bag is not in use and is disposed about said umbrella shaft proximal end, said storage bag defining:

an open end defining a perimeter about which is formed a circumferential hem extending substantially about said perimeter, said circumferential hem defining a first opening at a first end thereof and a second opening at a second end thereof;

a drawstring received within said circumferential hem, said drawstring defining a first end extending from said first opening in said circumferential hem and a second end extending from said second opening in said circumferential hem, said drawstring provided for reducing said perimeter of said storage bag when said anchor bag and said umbrella shaft proximal end are received within said storage bag; and a conventional cord lock configured to slidably receive said drawstring first and second ends, said cord lock being slidable along said drawstring when engaged and to maintain a relative position with said drawstring when not engaged.

7. The umbrella anchor of claim 6 wherein:

said upper harness further including:

an auxiliary strap defining a proximal end secured in a conventional manner at a selected location to said upper harness and a distal end; and a first mating portion of a conventional buckle carried by said distal end of said auxiliary strap; and said storage bag further including:

an attachment strap defining a proximal end secured to said storage bag and a distal end; and a second mating portion of said conventional buckle carried by said distal end of said attachment strap and releasably securable to said first mating portion such that when said umbrella anchor is employed, said storage bag may be removably secured to said upper harness to store miscellaneous personal items.

8. The umbrella anchor of claim 7 wherein said first mating portion is a female portion and wherein said second mating portion is a male portion.

9. The anchor bag of claim 1 wherein said at least one retaining strap includes an upper retaining strap disposed proximate said proximal end of each of said plurality of upper harness straps and a lower retaining strap disposed proximate said distal end of each of said plurality of the upper harness straps, wherein said upper retaining strap defines a first length and said lower retaining strap defines a second length longer than said first length.

10. An umbrella anchor for anchoring a conventional umbrella into a selected earthen material, the conventional umbrella including an umbrella shaft having a proximal end and a distal end and a canopy disposed at the distal end of the umbrella shaft, said umbrella anchor comprising:

an anchor bag configured to be received within a hole defined below grade by removing a selected volume of earthen material from the ground and for receiving at least a portion of said selected volume of earthen material, said anchor bag including:

an anchor bag substrate fabricated from a durable material having an upper surface and a lower surface when laid flat, said bag substrate defining a perimeter about which is formed a circumferential hem extending substantially about said perimeter, said circumferential hem defining a first opening at a first end thereof and a second opening at a second end thereof, and said anchor bag substrate defining a through opening at an approximate center thereof for receiving at least a portion of the conventional umbrella shaft proximal end;

a drawstring received within said circumferential hem, said drawstring defining a first end extending from said first opening in said circumferential hem and a second end extending from said second opening in said circumferential hem, said drawstring provided for reducing said perimeter of said anchor bag substrate when said portion of said selected volume of earthen material is placed on said anchor bag substrate; and a conventional cord lock configured to slidably receive said drawstring first and second ends, said cord lock being slidable along said drawstring when engaged and to maintain a relative position with said drawstring when not engaged;

an anchor bag harness disposed on and carried by said anchor bag substrate lower surface, said anchor bag harness including:

a plurality of anchor bag harness straps, each defining a proximal end disposed proximate said anchor bag substrate through opening and a distal end extending beyond said anchor bag substrate perimeter, said plurality of anchor bag harness straps being oriented radially away from said anchor bag substrate through opening and being substantially equally spaced apart in an angular array, a portion of each of said plurality of anchor bag harness straps from about said proximal end to about said anchor bag substrate perimeter being selectively secured to said anchor bag substrate;

a plurality of first mating portions of a conventional buckle, one each of said plurality of first mating portions for engaging said distal end of one each of said plurality of anchor bag harness straps; and a ring member defining an opening having an inner diameter, said ring being disposed proximate said anchor bag substrate through opening, wherein said proximal end of each of said plurality of anchor bag harness straps is received through said ring opening and secured to itself in a conventional manner, wherein each of said anchor bag substrate through opening and said ring member opening are larger than a diameter of at least a portion of said umbrella shaft;

an upper harness removably attached to the umbrella shaft, and releasably attached to said anchor bag harness, said upper harness including:

a mounting ring configured to be releasably attachable to said conventional umbrella shaft at a selected location;

a plurality of upper harness straps, each defining a proximal end secured to said mounting ring and a distal end, said plurality of upper harness straps being substantially equally spaced apart in an angular array relative to each other of said plurality of upper harness straps, wherein said plurality of upper harness straps is equal to said plurality of anchor bag harness straps;

a plurality of second mating portions of said conventional buckle, one each of said plurality of second mating portions for engaging said distal end of one each of said plurality of upper harness straps, and one each of said plurality of second mating portions of said conventional buckle being releasably engageable with one of said plurality of first mating portions of said conventional buckle to form a plurality of anchor bag harness strap/upper harness strap pairs, wherein one of said plurality of first mating portions and said plurality of second mating portions is slidably received on a respective of said plurality of anchor bag harness straps and said plurality of upper harness straps in order to adjust tension on each of said plurality of anchor bag harness strap/upper harness strap pairs; and at least one retaining strap configured to encircle and be secured to each of said plurality of upper harness straps at a selected location, in order to maintain said angular array; and a storage bag, said storage bag configured to receive at least said anchor bag and said umbrella shaft proximal end when said anchor bag is not in use and is disposed about said umbrella shaft proximal end, said storage bag defining:

an open end defining a perimeter about which is formed a circumferential hem extending substantially about said perimeter, said circumferential hem defining a first opening at a first end thereof and a second opening at a second end thereof;

a drawstring received within said circumferential hem, said drawstring defining a first end extending from said first opening in said circumferential hem and a second end extending from said second opening in said circumferential hem, said drawstring provided for reducing said perimeter of said storage bag when said anchor bag and said umbrella shaft proximal end are received within said storage bag; and a conventional cord lock configured to slidably receive said drawstring first and second ends, said cord lock being slidable along said drawstring when engaged and to maintain a relative position with said drawstring when not engaged.

11. The umbrella anchor of claim 10 wherein said earthen material is sand and wherein said conventional umbrella is a beach umbrella.

12. The umbrella anchor of claim 10 wherein each of said plurality of first mating portions is a male portion and is configured to be slidably engaged with one each of said plurality of anchor bag harness strap distal ends, and wherein each of said plurality of second mating portions is a female portion and is fixedly secured to one each of said plurality of upper harness strap distal ends.

13. The umbrella anchor of claim 10 wherein:

said upper harness further including:

an auxiliary strap defining a proximal end secured in a conventional manner at a selected location to said upper harness and a distal end; and a first mating portion of a conventional buckle carried by said distal end of said auxiliary strap; and said storage bag further including:

an attachment strap defining a proximal end secured to said storage bag and a distal end; and a second mating portion of said conventional buckle carried by said distal end of said attachment strap and releasably securable to said first mating portion such that when said umbrella anchor is employed, said storage bag may be removably secured to said upper harness to store miscellaneous personal items.

14. The umbrella anchor of claim 13 wherein said first mating portion is a female portion and wherein said second mating portion is a male portion.

15. The anchor bag of claim 10 wherein said at least one retaining strap includes an upper retaining strap disposed proximate said proximal end of each of said plurality of upper harness straps and a lower retaining strap disposed proximate said distal end of each of said plurality of the upper harness straps, wherein said upper retaining strap defines a first length and said lower retaining strap defines a second length longer than said first length.

16. An umbrella anchor for anchoring a conventional umbrella into a selected earthen material, the conventional umbrella including an umbrella shaft having a proximal end and a distal end and a canopy disposed at the distal end of the umbrella shaft, said umbrella anchor comprising:

an anchor bag configured to be received within a hole defined below grade by removing a selected volume of earthen material from the ground and for receiving at least a portion of said selected volume of earthen material, said anchor bag including:

an anchor bag substrate fabricated from a durable material having an upper surface and a lower surface when laid flat, said bag substrate defining a perimeter about which is formed a circumferential hem extending substantially about said perimeter, said circumferential hem defining a first opening at a first end thereof and a second opening at a second end thereof, and said anchor bag substrate defining a through opening at an approximate center thereof for receiving at least a portion of the conventional umbrella shaft proximal end;

a drawstring received within said circumferential hem, said drawstring defining a first end extending from said first opening in said circumferential hem and a second end extending from said second opening in said circumferential hem, said drawstring provided for reducing said perimeter of said anchor bag substrate when said portion of said selected volume of earthen material is placed on said anchor bag substrate; and a conventional cord lock configured to slidably receive said drawstring first and second ends, said cord lock being slidable along said drawstring when engaged and to maintain a relative position with said drawstring when not engaged;

an anchor bag harness disposed on and carried by said anchor bag substrate lower surface, said anchor bag harness including:

a plurality of anchor bag harness straps, each defining a proximal end disposed proximate said anchor bag substrate through opening and a distal end extending beyond said anchor bag substrate perimeter, said plurality of anchor bag harness straps being oriented radially away from said anchor bag substrate through opening and being substantially equally spaced apart in an angular array, a portion of each of said plurality of anchor bag harness straps from about said proximal end to about said anchor bag substrate perimeter being selectively secured to said anchor bag substrate;

a plurality of first mating portions of a first conventional buckle, one each of said plurality of first mating portions for engaging said distal end of one each of said plurality of anchor bag harness straps; and a ring member defining an opening having an inner diameter, said ring being disposed proximate said anchor bag substrate through opening, wherein said proximal end of each of said plurality of anchor bag harness straps is received through said ring opening and secured to itself in a conventional manner, wherein each of said anchor bag substrate through opening and said ring member opening are larger than a diameter of at least a portion of said umbrella shaft;

an upper harness removably attached to the umbrella shaft, and releasably attached to said anchor bag harness, said upper harness including:

a mounting ring configured to be releasably attachable to said conventional umbrella shaft at a selected location;

a plurality of upper harness straps, each defining a proximal end secured to said mounting ring and a distal end, said plurality of upper harness straps being substantially equally spaced apart in an angular array relative to each other of said plurality of upper harness straps, wherein said plurality of upper harness straps is equal to said plurality of anchor bag harness straps;

a plurality of second mating portions of said first conventional buckle, one each of said plurality of second mating portions for engaging said distal end of one each of said plurality of upper harness straps, and one each of said plurality of second mating portions of said first conventional buckle being releasably engageable with one of said plurality of first mating portions of said conventional buckle to form a plurality of anchor bag harness strap/upper harness strap pairs, wherein one of said plurality of first mating portions and said plurality of second mating portions is slidably received on a respective of said plurality of anchor bag harness straps and said plurality of upper harness straps in order to adjust tension on each of said plurality of anchor bag harness strap/upper harness strap pairs;

at least one retaining strap configured to encircle and be secured to each of said plurality of upper harness straps at a selected location, in order to maintain said angular array;

an auxiliary strap defining a proximal end secured in a conventional manner at a selected location to said upper harness and a distal end; and a first mating portion of a second conventional buckle carried by said distal end of said auxiliary strap; and a storage bag, said storage bag configured to receive at least said anchor bag and said umbrella shaft proximal end when said anchor bag is not in use and is disposed about said umbrella shaft proximal end, said storage bag defining:

an open end defining a perimeter about which is formed a circumferential hem extending substantially about said perimeter, said circumferential hem defining a first opening at a first end thereof and a second opening at a second end thereof;

a drawstring received within said circumferential hem, said drawstring defining a first end extending from said first opening in said circumferential hem and a second end extending from said second opening in said circumferential hem, said drawstring provided for reducing said perimeter of said storage bag when said anchor bag and said umbrella shaft proximal end are received within said storage bag;

a conventional cord lock configured to slidably receive said drawstring first and second ends, said cord lock being slidable along said drawstring when engaged and to maintain a relative position with said drawstring when not engaged;

an attachment strap defining a proximal end secured to said storage bag and a distal end; and a second mating portion of said second conventional buckle carried by said distal end of said attachment strap and releasably securable to said first mating portion of said second conventional buckle such that when said umbrella anchor is employed, said storage bag may be removably secured to said upper harness to store miscellaneous personal items.

17. The umbrella anchor of claim 16 wherein said earthen material is sand and wherein said conventional umbrella is a beach umbrella.

18. The umbrella anchor of claim 16 wherein each of said plurality of first mating portions of said first conventional buckle is a male portion and is configured to be slidably engaged with one each of said plurality of anchor bag harness strap distal ends, and wherein each of said plurality of second mating portions of said first conventional buckle is a female portion and is fixedly secured to one each of said plurality of upper harness strap distal ends.

19. The umbrella anchor of claim 16 wherein said first mating portion of said second conventional buckle is a female portion and wherein said second mating portion of said second conventional buckle is a male portion.

20. The anchor bag of claim 16 wherein said at least one retaining strap includes an upper retaining strap disposed proximate said proximal end of each of said plurality of upper harness straps and a lower retaining strap disposed proximate said distal end of each of said plurality of the upper harness straps, wherein said upper retaining strap defines a first length and said lower retaining strap defines a second length longer than said first length.

* * * * *